United States Patent [19]

Dätwyler

[11] 4,201,297

[45] May 6, 1980

[54] PACKAGE ARRANGEMENT FOR A DOCTOR BLADE, ESPECIALLY FOR AN INTAGLIO OR GRAVURE PRINTING DOCTOR

[75] Inventor: Max Dätwyler, Bleienbach, Switzerland

[73] Assignee: Max Datwyler & Co., Bleienbach, Switzerland

[21] Appl. No.: 41,237

[22] Filed: May 21, 1979

[30] Foreign Application Priority Data

May 30, 1978 [DE] Fed. Rep. of Germany ..... 2823603

[51] Int. Cl.[2] ..... B65D 85/54

[52] U.S. Cl. ..... 206/349; 206/820; 206/372

[58] Field of Search ..... 206/349, 820, 352, 354, 206/372

[56] References Cited

U.S. PATENT DOCUMENTS

| | | | |
|---|---|---|---|
| 2,798,594 | 7/1957 | Dillon | 206/820 |
| 2,954,118 | 9/1960 | Anderson | 206/349 |

*Primary Examiner*—William T. Dixon, Jr.
*Attorney, Agent, or Firm*—Werner W. Kleeman

[57] ABSTRACT

A doctor or doctor blade is embedded in an enclosure or casing formed of plastic. The portion of such enclosure covering the region of a work edge of the doctor blade is connected with the remaining part of the enclosure by means of a reference fracture location in the form of notch-shaped weakening lines. These weakening lines determine the separation location between both of the enclosure sections or portions. After mounting the doctor blade, protected by the enclosure or casing, the work edge is exposed by separating the enclosure portion or section covering the work edge, whereas the remaining part of the enclosure remains at the doctor blade.

16 Claims, 10 Drawing Figures

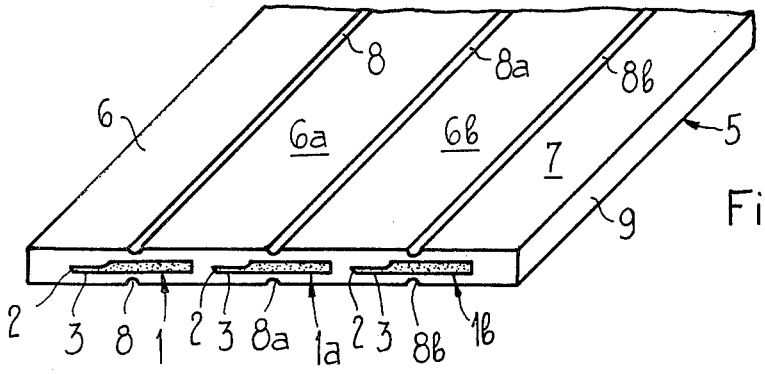
Fig.7
Fig.8
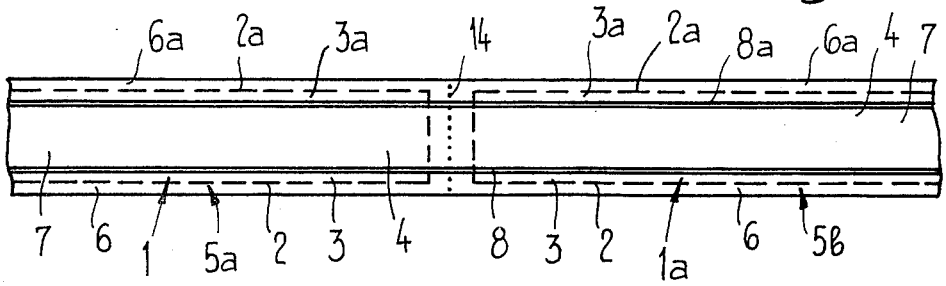
Fig. 9
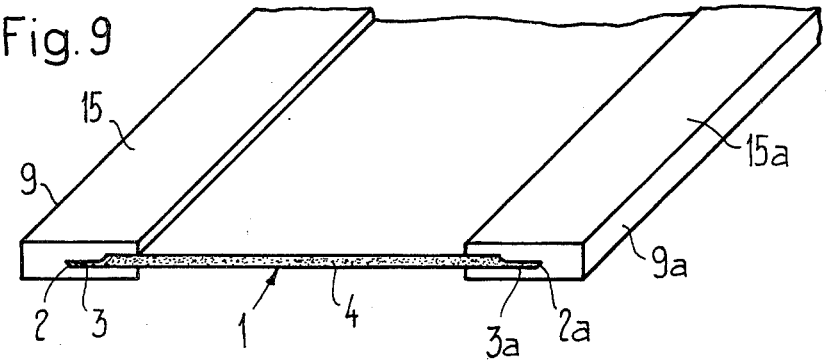
Fig. 10
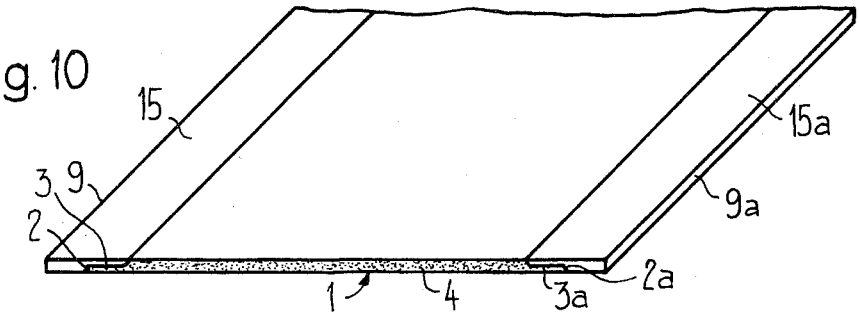

PACKAGE ARRANGEMENT FOR A DOCTOR BLADE, ESPECIALLY FOR AN INTAGLIO OR GRAVURE PRINTING DOCTOR

BACKGROUND OF THE INVENTION

The present invention relates to a new and improved packaging arrangement for a doctor blade or doctor, especially for gravure or intaglio printing, this doctor blade having at least one work edge at one of its longitudinal sides.

As is well known in this technology the work edge of a doctor blade is susceptible to mechanical damage which can occur during storage, transport, mounting of the doctor blade in the doctor holder and during the assembly of the latter at the printing machine.

SUMMARY OF THE INVENTION

Therefore, with the foregoing in mind it is a primary object of the present invention to provide a new and improved construction of packaging arrangement for a doctor blade which prevents the aforementioned occurrences.

Still a further significant object of the present invention aims at effectively avoiding, or at the very least appreciably minimizing, the danger of damage to the doctor blade, especially its work edge.

Yet a further significant object of the present invention concerns an improved packaging arrangement for a doctor blade, especially for use with a gravure or intaglio printing machine, wherein damage to the doctor blade is effectively precluded by the packaging arrangement, whereas the latter itself is constructed in a manner facilitating rapid exposure of the working edge of the doctor blade when such should be placed into use.

Another and more specific object of the invention aims at a new and improved construction of doctor packaging arrangement of the previously mentioned type wherein at least the work edge of the doctor blade or doctor is provided with an easily attainable, priceworthy and effective protection, which can be again easily removed, prior to use of the doctor blade, at least at the region of its work or working edge.

Now in order to implement these and still further objects of the invention, which will become more readily apparent as the description proceeds, the packaging arrangement of the present invention is manifested by the features that the doctor blade is enclosed or surrounded by an enclosure or casing means, preferably formed of plastic. The section or portion of the enclosure covering the region of the work edge of the doctor blade is detachably connected with the remaining portion or section of the enclosure by means of a separation location, so that upon separating this enclosure portion the work edge of the doctor blade is freely exposed, while the remaining portion of the enclosure remains at the doctor blade.

By virtue of this solution there is afforded the advantage that the doctor blade together with the enclosure can remain clamped in the doctor holder, so that during this working operation, and equally upon subsequent mounting of the doctor holder in the printing machine, the doctor blade remains protected against mechanical damage. Additionally, the operator of the equipment is protected against injury at the sharp doctor blade edges. other after the doctor holder has been clamped at the printing machine is the work edge of the doctor blade exposed following removal of the disconnectable enclosure portion or section. The portion of the enclosure remaining at the doctor blade and clamped in the doctor holder exerts an oscillation damping effect, something which, under circumstances, renders superfluous the use of the frequently employed support doctor. The enclosure or casing therefore not only serves as a packaging device, but also as a damping element. Additionally, this enclosure acts as a corrosion protection, rendering possible storage of the fabricated doctor blade without the latter, prior to its use, having to again be post-machined.

According to a preferred embodiment of the invention, the enclosure or casing means possesses at least at one longitudinal side, which faces away from a work edge of the blade, with an impact edge or surface, insuring for proper positioning of the doctor blade in the doctor holder.

Within the enclosure there can be arranged a doctor band having a length amounting to a multiple of the doctor blade, which doctor band possesses at least at one lengthwise or longitudinal side thereof a continuous work edge covered by the detachable portion of the enclosure. Consequently, it is possible to mount the doctor in roll configuration without any danger of damaging the same, and when necessary, to cut-off a doctor or doctor blade of the desired length together with the enclosure from the roll.

When providing a packaging arrangement for a doctor having at opposite sides a respective portion or section extending in lengthwise direction, which is provided with a work edge and has a thickness less than the thickness of the intermediate doctor portion, the objectives of the invention can be further realized by covering each of both work sections together with its work edge by means of a detachably adhering protection whose portion covering the work region or section has a thickness amounting essentially to the difference between the thickness of the intermediate doctor portion or section and the thickness of the work portion or section.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 7 is a fragmentary perspective view of a packaging arrangement wherein a number of mutually parallel and tandemly arranged doctor blades are embedded in an enclosure or casing;

FIG. 8 is a top plan view showing a number of adjacently arranged doctor blades embedded in an enclosure or casing; and FIGS. 9 and 10 show in fragmentary perspective view two further embodiments of a doctor blade having two work edges protected by a protection element.

DETAILED DESCRIPTION OF THE PREFERRED EMBODIMENTS

Figure 1:
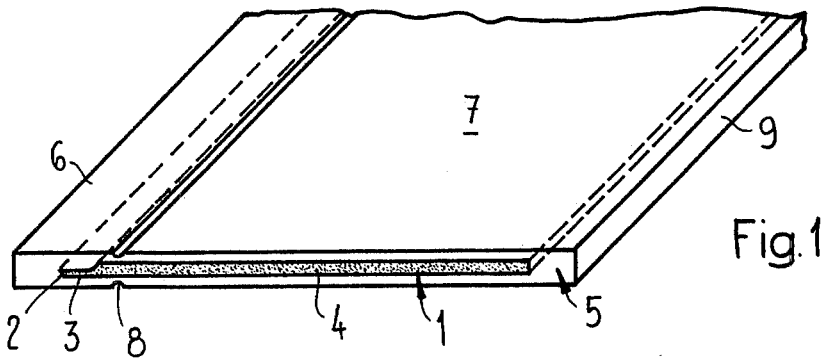
FIG. 1 is a fragmentary perspective view of a first embodiment of a doctor or doctor blade surrounded by an enclosure or casing according to the invention.

Describing now the drawings, the doctor blade arrangement, illustrated by way of example in FIG. 1, shows a doctor blade or doctor, generally designated by reference character 1, which has a conventional shape and is provided for use during gravure or intaglio printing processes. The doctor blade 1 possesses at one lengthwise or longitudinal side a work or working edge 2, the so-called doctor bevel, by means of which the doctor blade 1, as is known, bears against the intaglio printing cylinder or other printing-image carrier. This work edge 2 is located at the front end of an offset front portion or section 3 formed of one piece with the rear section or portion 4 of the doctor blade 1. This rear portion or section 4 has a greater thickness than the front section or portion 3. The doctor blade 1 is embedded in an enclosure or casing means 5 formed of a plastic material, the enclosure or casing 5 having an essentially rectangular cross-sectional configuration. A portion or section 6 of this enclosure 5, which covers the region of the portion or section 3 of the doctor blade 1, and thus, the work edge 2, is disconnectable from the main portion or section 7 of the enclosure 5. Between the enclosure sections or portions 6 and 7 there is provided a reference fracture location in the form of, for instance, notch-shaped weakening or facture lines 8 or equivalent structure, forming the separation location between the portions 6 and 7 and rendering possible an easy removal of the section or portion 6. By removing this enclosure portion 6, as will be explained still more fully hereinafter in conjunction with FIG. 3, the doctor work edge 2 is exposed. In order to be able to clamp the doctor blade 1 in conjunction with the enclosure or casing 5 without any problem in a standard doctor blade holder, the narrow side 9 of the enclosure 5, constituting a packaging means for the doctor blade, and which narrow side faces away from the doctor work edge 2, is structured as an impact or stop surface.

Figure 2:
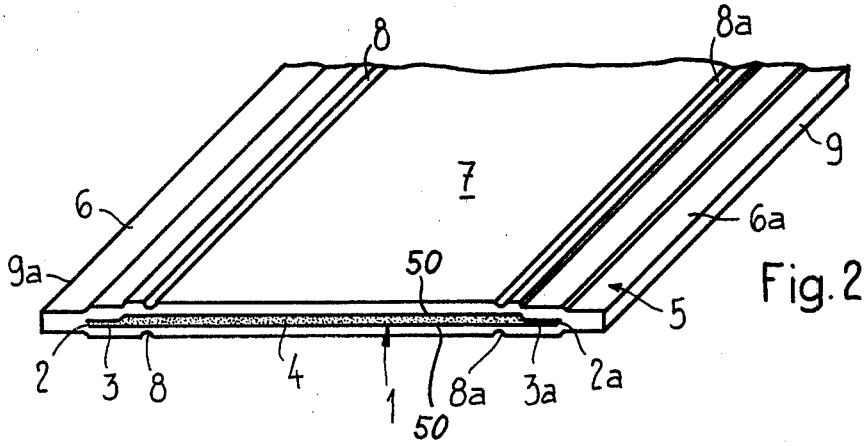
FIG. 2 is a fragmentary perspective view of a second embodiment of a doctor blade surrounded by an enclosure or casing.

As best seen by referring to FIG. 2, there are also known doctor blades or doctors 1 which have work edges 2 and 2a at both longitudinal sides thereof. Each of these doctor work edges 2 and 2a is located at the front end of an offset front portion or section 3 and 3a, respectively, formed of one piece with the central portion or section 4 of the doctor blade. As already mentioned previously when describing the arrangement of FIG. 1, this intermediate or central portion 4 has a larger thickness than the front sections or portions 3 and 3a. Such doctor blade 1 having two work edges 2 and 2a therefore, without any post-machining or other machining work, can be used twice in that, after wear of one work edge 2 the doctor blade 1 is reversed in position, so that the other work edge 2a can now be used. Such two-edge usable doctor blade 1 however only then can be appropriately employed if measures are taken to insure that, upon clamping or mounting the doctor blade in the doctor holder, the initially unused work edge 2a is protected against damage.

Such protection, as clearly evident from the showing of FIG. 2, is afforded by the packaging arrangement composed of the enclosure or casing 5 formed of plastic. The doctor blade 1 is embedded in the enclosure or enclosure means 5, and thus, protected in conjunction with its work edges 2 and 2a. The enclosure 5 has two disconnectable portions or sections 6 and 6a, each of which cover the region of a related doctor blade-work edge 2 and 2a, respectively. Just as was the case for the embodiment of FIG. 1, here between the intermediate portion or section 7 of the packaging enclosure or enclosure means 5 and each disconnectable enclosure section or portion 6 and 6a there is provided a reference fracture location, for instance formed by notch-like weakening or fracture lines 8 and 8a, respectively. These notchlike weakening or fracture lines 8 and 8a constitute the separation line between the sections or portions 7 and 6 and 7 and 6a, as the case may be, and facilitate the severance of such portions or sections 6 and 6a. At least the one narrow surface 9 of the enclosure 5 is constructed as an impact or stop surface, which, as already mentioned in conjunction with the disclosure of the arrangement of FIG. 1, insures for the proper positioning of the doctor blade 1 during mounting thereof in the doctor holder. However, it is also possible to likewise construct the opposite narrow surface 9a as an impact or stop surface. This affords the advantage that the doctor blade 1, with its one work edge 2a or its other work edge 2 leading, can be mounted without any problem in the doctor holder which can be of conventional design as is well known in this technology. The enclosure 5 according to the showing of FIG. 2, as required for reasons of fabrication, has a somewhat different cross-sectional configuration than the enclosure 5 of the arrangement of FIG. 1. The enclosure 5 of FIG. 2 is formed in that, the doctor blade 1 is covered at the upper surface and lower surface with a respective plastic foil, generally indicated by reference character 50, the edges of which are subsequently welded or otherwise interconnected with one another. During or after this welding step, it must be insured that, as mentioned, at least the one narrow side 9 can serve as an impact or stop surface.

Figure 3:
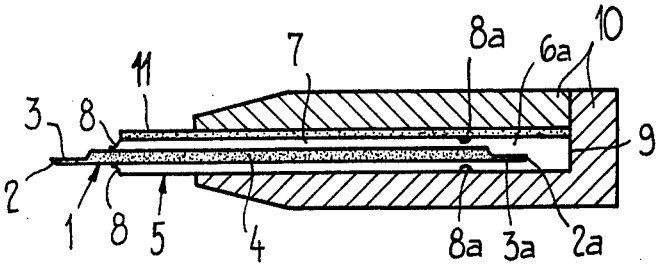
FIG. 3 is a sectional view of a doctor or doctor blade, according to the showing of FIG. 2, clamped in a doctor holder or support.

FIG. 3 shows in sectional view the doctor blade arrangement of FIG. 2 which is clamped in conjunction with a support doctor or doctor blade 11 in a doctor holder 10. The doctor blade 1 together with the enclosure or casing 5 is clamped, with the work edge 2a leading, into the doctor holder 10, and, as already mentioned, the narrow side 9 of the enclosure 5 serves as an impact or stop surface. By means of this narrow side-stop surface 9 the enclosure 5 comes into contact with the doctor holder 10, affording an exact positioning of the doctor blade or doctor 1. After the doctor blade 1 has been clamped in the doctor holder 10 and following mounting of the latter in the printing machine, the section or portion 6 of the enclosure 5 is separated along the notch-like weaking or tear lines 8 from the section or portion 7 of such enclosure 5. Consequently, the doctor work edge 2 is exposed. Also as seen by referring to FIG. 3, and as already mentioned, the remaining part of the enclosure 5, i.e., the main portion 7 and the other disconnectable or tear-off portion or section 6a thereof remains connected with the doctor blade 1 and together with such doctor blade 1 is retained by the doctor holder 10 together with the support doctor 11. This remaining part of the enclosure or casing 5 now serves, in addition to the support doctor 11, as means for damping oscillations. As is well known the conventional doctor blades, especially when operating with high printing speeds, tend to vibrate. This produces an undesired impairment in the quality of the printed product. A damping of such oscillations is therefore extremely desirable. The enclosure 5 since, in the first instance, it of course serves to protect the doctor blade 1 against damage, thus has an extremely desirable oscillation damping action. It is even possible, by virtue of the effect of the enclosure of casing 5, in certain instances, to dispense with the use of the support doctor 11 or equivalent structure.

After the work edge 2 has become worn, then the doctor blade 1 is reversed, so that now the worn work edge 2 is disposed internally of the doctor blade 10, whereas the still unused work edge 2a now protrudes past the doctor holder 10. After disconnecting the portion or section 6a of the enclosure or casing 6, this new work edge 2a is exposed. The main portion or section 7 of the enclosure 5 however remains, as was previously similarly the case, connected with the doctor blade 1, so that also after reversal of the position of the doctor blade 1 there is still beneficially maintained the oscillation damping action of the enclosure or casing 5.

By virtue of the fact that the initially unused work edge 2a comes to lie within the doctor holder 10 and is protected by the section or portion 6a of the enclosure 5, this work edge 2a, upon mounting of the doctor blade 1 in the doctor holder 10, is not damaged. Also the other work edge 2, upon mounting of the doctor blade 1 in the doctor holder 10 and upon subsequent installation of the doctor holder 10 in the not particularly illustrated printing machine, is protected against damage by the section or portion 6 of the enclosure or casing 5. Since the sharp work edges 2 and 2a are not exposed during mounting, there is also precluded the danger of injury to the operator due to the sharp work edges 2 and 2a.

Figure 4:
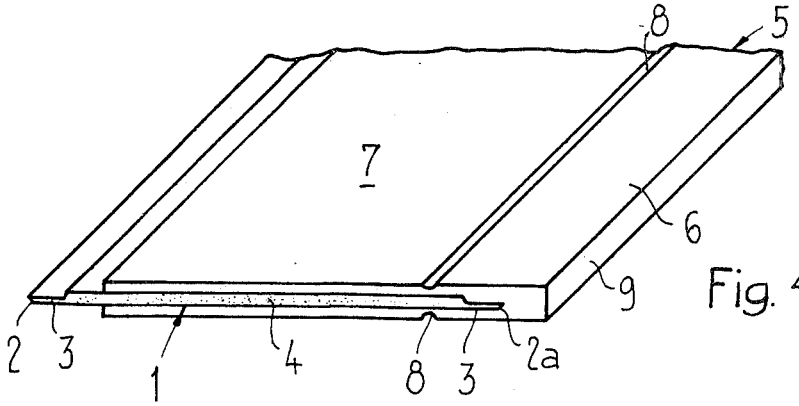
FIGS. 4, 5 and 6 each respectively show in fragmentary perspective view further variant constructions of a doctor blade with associated enclosure or casing.

Now in FIG. 4 there is shown an exemplary embodiment wherein the doctor blade 1 is constructed, like for the arrangement of FIG. 2, so as to have two work edges 2 and 2a. Yet, in contrast to the embodiment of FIG. 2, here the work edge 2 is not covered by the enclosure 5 and therefore is freely exposed. On the other hand, the other work edge 2a is embedded in the disconnectable or frangible section or portion 6 of the enclosure 5, and thus, protected. With this doctor blade arrangement there of course initially can be used the work edge 2. If this work edge 2 is worn, then, as already explained previously in conjunction with the description of FIG. 3, the doctor blade 1 is reversed and by tearing away the section or portion 6 there is exposed the other work edge 2a. The variant of FIG. 4 has the drawback that the work edge 2 remains unprotected.

Figure 5:
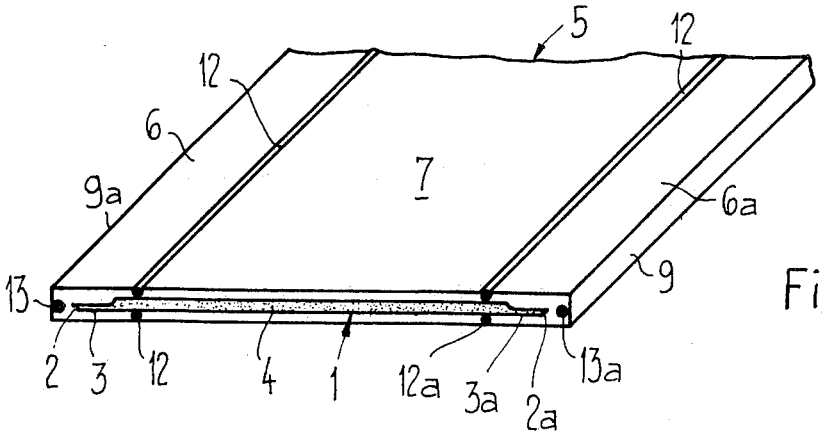

The embodiment of FIG. 5 corresponds, with few exceptions, to the embodiment of FIG. 2. Here, however, the enclosure or casing 5, for this embodiment, is constructed in the manner of a tearable or frangible package. The separation of disconnection location between the main portion or section 7 and the disconnectable sections or portions 6 and 6a of the enclosure or casing 5 is formed by tear elements 12 and 12a, for instance cords or threads, embedded in the enclosure or casing 5. By tearing these tear elements 12 and 12a the sections 6 and 6a are separated from the main portion or section 7.

For the additional protection of the work edges 2 and 2a there are provided at the disconnectable portions or sections 6 and 6a reinforcement elements 13 and 13a, for instance wires or cords or equivalent structure. These reinforcement elements 13 and 13a extend along the work edges 2 and 2a, respectively, and especially afford an increased protection against damage by blows or impacts.

Figure 6:
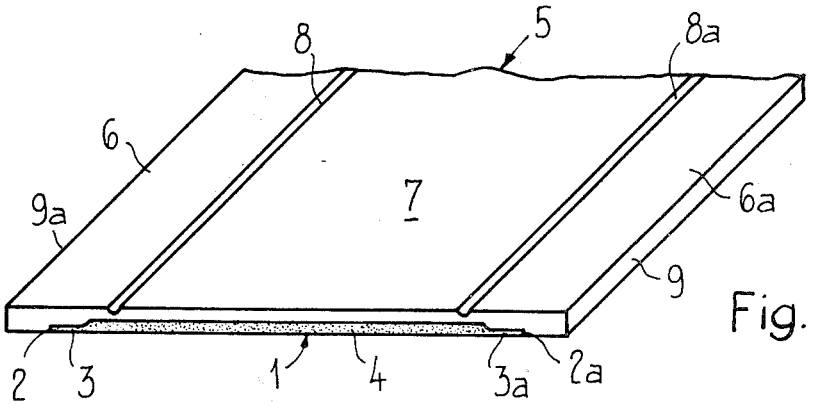

With the embodiment shown in FIG. 6 the doctor blade 1, in contrast to the embodiment of FIG. 2, is not completely surrounded by the enclosure or casing 5. As particularly well seen by referring to FIG. 6, the enclosure 5 only covers the top side or surface of the doctor blade 1, whereas its underside or lower surface is exposed. What is however important is that also with this variant, the work edges 2 and 2a are protected against damage by the enclosure or casing 5. By removing the sections or portions 6 and 6a there is exposed, for use, the work edges 2 and 2a, respectively.

In the arrangement of FIG. 7 there are positioned, within the enclosure of casing 5, a number of mutually parallel and tandemly arranged doctor blades or doctors 1, 1a and 1b. Each such doctor blade 1, 1a and 1b corresponds in shape to the doctor blade 1 of the arrangement of FIG. 2. The enclosure or casing 5 comprises a major or base portion 7 and three disconnectable portions or sections 6, 6a and 6b. With this constructional embodiment the three tandemly arranged doctor blades 1, 1a and 1b, together with the enclosure 5, having at its rear side an impact surface 9, are clamped in a suitable doctor holder. By disconnecting the forwardmost section or portion 6 there is then exposed the work edge 2 of the forwardmost doctor blade or doctor 1. If the work edge 2 of the doctor blade 1 is worn, then the entire doctor arrangement is advanced, so that the doctor blade edge 2 of the following doctor blade 1a protrudes past the doctor holder. After disconnecting the second section or portion 6a the work edge 2 of the second doctor blade 1a is freed, and at the same time, there is removed the worn doctor blade 1. Utilizing the same operations, by removing the third section or portion 6b, there is exposed the work edge 2 of the third doctor blade 1b. The major or main portion 7 of the enclosure or casing 5 remains connected with the third doctor blade 1b.

FIG. 8 shows in top plan view a doctor blade arrangement, wherein the individual doctor blades 1 and 1a are arranged next to one another. Each of these doctor blades 1 and 1a are of the same construction as the doctor blade 1 shown in FIG. 2. The enclosure or casing 5 is formed by a number of mutually interconnected portions or parts 5a and 5b which can be disconnected from one another along a separation location or separation means 14, for instance constituted by perforations or equivalent disconnection means. In each enclosure portion 5a and 5b there is embedded a doctor blade 1 and 1a, respectively. The removable sections 6 and 6a of each enclosure portion 5a, 5b and which sections cover the work edges 2 and 2a of the doctor blades 1 and 1a, can be detached along the notch-shaped weakening or frangible lines 8 and 8a from the major or base portion 7 of the enclosure 5, as the same has already been disclosed heretofore in conjunction with the embodiment of FIG. 2. The individual doctor blades or doctors 1 and 1a, suspended at one another together with their enclosure 5a and 5b, respectively, form a band from which, in each case, there can be cut-off a doctor blade by separating the enclosure along the separation location or line 14. This doctor band composed of the individual doctors or doctor blades 1 and 1a suspended at one another, can be conveniently wound-up into a roll. Since the individual doctor blades 1 and 1a are protected by the enclosure or casing means 5a, 5b, the doctors can be mounted in a rolled-up configuration, without damage occurring to the doctor blades or doctors.

Instead of, as shown in FIG. 8, embedding individual doctor blades 1 and 1a, cut-to-length, in a band-shaped enclosure or casing means 5a, 5b, it is also possible to fabricate a doctor band having a length amounting to a multiple of a doctor blade and which is provided at one or both longitudinal or lengthwise sides with a work edge 2 and 2a, as the case may be, and such doctor band, analogous to the showing of FIG. 8, can equally be embedded in a likewise band-shaped enclosure means or enclosure. In contrast to the embodiment of FIG. 8, this enclosure means however does not have any separation location 14, since, upon disconnection of a doctor blade from this doctor band, there is simultaneously accomplished a disconnection of the enclosure means. Also with this embodiment the doctor band can be wound-up into a roll, from which, when needed, there can be cut-off a doctor blade of the desired length. With all of the illustrated embodiments, one is concerned therefore both with a part of an individual doctor blade provided with an enclosure as well as also a section of such type doctor band which is embedded in an enclosure.

With the exemplary embodiment according to FIGS. 9 and 10, the entire doctor blade or doctor 1 is not surrounded by an enclosure or casing. Here, only the region of each work edge 2 and 2a is protected by a protection element 15 and 15a, respectively. These protection elements 15 and 15a, preferably formed of plastic, can be easily removed in order to provide exposure or access to the corresponding work edge 2 and 2a.

Now in the arrangement of FIG. 9 the protection elements 15 and 15a are thicker than the doctor blade 1, while in the arrangement of FIG. 10 these protection elements 15 and 15a are only applied with a thickness of a section or portion 4. In the last-mentioned case the protection elements 15 and 15a only cover the offset front portions or sections 3 and 3a together with the work edges 2 and 2a of the doctor blade 1.

As mentioned, the described protection of the work edges 2 and 2a especially provides advantages in conjunction with doctor blades having, at both longitudinal sides, work edges 2 and 2a. However, such protection also affords appreciable advantages when used in conjunction with doctor blades having only a single work or working edge 2.

As far as the material for the enclosure or casing means 5 or 5a, 5b or the protection elements 15 and 15a are concerned, as previously mentioned plastic materials are particularly suitable. However, also other materials can be used, and in the selection of the proper material care must be taken that such are resistant to the printing ink with which the enclosure or casing comes into contact. This is particularly so as concerns the solvent contained in the printing ink.

Plastics are particularly suitable by virtue of their rational processability as a material for the enclosure. It should be understood that the embedding of the doctor blade or doctor band in the enclosure should be accomplished in a most favorable manner from the standpoint of economy or cost. With respect to these aspects, there have been found, among others, the following methods:

(a) embedding the doctor or the doctor band in plastic foils with subsequent welding or heat sealing of the foil edges;

(b) coating of the doctor or doctor band with plastic after an extrusion method;

(c) immersion coating of the doctor or the doctor band;

(d) spraying of a plastic coating or layer onto the doctor or the doctor band, and subsequent calibration with an appropriate tool; and (e) powder coating of the doctor or the doctor band with subsequent calibration.

Of course, there are available for use other suitable processes. A particularly rational fabrication technique can then be realized if there are formed at a steel band, at one or both longitudinal sides, during a continuous working step, the offset or stepped front portions or sections 3 and 3a having the work surfaces or edges 2 and 2a, respectively, and subsequently, likewise in a continuous operation, embedding the steel band in a plastic enclosure or casing. The portion or section 7 of the enclosure 5 which remains upon the doctor blade, following removal of each disconnectable portion or section 6 and 6a, is preferably fixedly connected with the doctor blade 1, for instance by high-frequency welding.

Although based upon the previously described embodiments, there has been explained a protection for doctor blades or doctors used in gravure or intaglio printing, it is also conceivable to protect doctors in a corresponding manner which are used for completely different purposes.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A packaging arrangement for at least one doctor blade, especially for gravure printing, having at least one work edge at one longitudinal side thereof, comprising:

enclosure means surrounding at least part of said doctor blade;

said enclosure means having a portion covering the work edge of the doctor blade; and means defining a separation location for disconnectingly joining said covering portion of the enclosure means with a remaining portion of said enclosure means, so that upon disconnection of said covering portion the work edge of the doctor blade is exposed while the remaining portion of the enclosure means remains at the doctor blade.

2. The packaging arrangement is defined in claim 1, especially for use with a number of doctor blades, wherein:

said enclosure means is structured to at least partially surround a number of essentially parallel and tandemly arranged individual doctor blades;

said separation means comprising structure providing a number of disconnectable enclosure portions; and each of said enclosure portions surrounding at least a region of the work edge of a related one of the number of doctor blades and after separation of such disconnectable enclosure portion exposing such work edge.

3. The packaging arrangement as defined in claim 1, for a number of doctor blades, wherein:

said enclosure means comprises a number of adjacently arranged portions;

said separation means including structure for disconnectingly joining said number of adjacently arranged portions with one another;

each of said adjacently arranged portions surrounding an associated individual doctor blade;

each adjacently arranged disconnectable enclosure portion having at least one disconnectable section covering the region of the work edge of the related doctor blade.

4. The packaging arrangement as defined in claim 1, wherein:

said enclosure means has arranged therein a doctor band having a length amounting to a multiple of one doctor blade;

said doctor band having at least at one longitudinal side thereof a continuous work edge; and said covering portion of said enclosure means covering said continuous work edge.

5. The packaging arrangement is defined in claim 1, for a number of doctor blades, each having at opposite longitudinal sides thereof a respective work edge, wherein:

said enclosure means has two such disconnectable portions, each covering the region of the related work edge, and disconnectable from the remaining portion of the enclosure means.

6. The packaging arrangement as defined in claim 1, wherein:

said separating means comprises at least one reference fracture location.

7. The packaging arrangement as defined in claim 6, wherein:

said reference fracture location comprises a frangible line.

8. The packaging arrangement as defined in claim 7, wherein:

said frangible line comprises notch means.

9. The packaging arrangement as defined in claim 7, wherein:

said frangible line comprises perforation means.

10. The packaging arrangement as defined in claim 1, further including:

at least one tear element arranged in the enclosure means at the region of the separation means.

11. The packaging arrangement as defined in claim 1, wherein:

said enclosure means has longitudinal sides;

at least one of the longitudinal sides of said enclosure means, facing away from the work edge of the doctor blade, being provided with structure defining an impact means.

12. The packaging arrangement as defined in claim 1, wherein:

said enclosure means possesses an essentially rectangular-shaped cross-sectional configuration.

13. The packaging arrangement as defined in claim 1, further including:

a reinforcement element arranged at the disconnectable portion of said enclosure means; and said reinforcement element extending along the work edge of the doctor blade and protecting such work edge.

14. The packaging arrangement as defined in claim 1, wherein:

said enclosure means is formed of a plastic material.

15. A packaging arrangement for a doctor blade, especially for gravure printing, the doctor blade having oppositely situated sides, each of which has a work portion extending in the lengthwise direction of the doctor blade, each work portion being provided with a work edge and having a thickness less than the thickness of an intermediate portion of the doctor blade, comprising:

a respective detachably adhering protection means for covering each of both work portions together with its work edge of the doctor blade;

each of said detachable adhering protection means having a portion covering the work portion of the doctor blade; and each said covering portion having a thickness corresponding essentially to the difference between the thickness of the intermediate doctor blade portion and the thickness of the work portion of the doctor blade.

16. The packaging arrangement as defined in claim 15, wherein:

at least one of the detachable adhering protection means has structure defining impact means.

* * * * *